United States Patent [19]

Dietrich

[11] Patent Number: 4,471,584

[45] Date of Patent: Sep. 18, 1984

[54] UNITIZED SKYLIGHT STRUCTURE

[75] Inventor: Douglas W. Dietrich, Wheeling, Ill.

[73] Assignee: IBG International, Inc., Prairie View, Ill.

[21] Appl. No.: 351,774

[22] Filed: Feb. 24, 1982

[51] Int. Cl.[3] ..... E04D 13/00; E06B 7/14; E04H 1/00; E04B 1/68

[52] U.S. Cl. ..... 52/14; 52/209; 52/235; 52/398; 52/573

[58] Field of Search ..... 52/14, 200, 208, 209, 52/465, 467, 469, 235, 306, 397, 398, 475, 80, 81, 82, 573

[56] References Cited

U.S. PATENT DOCUMENTS

| | | | |
|---|---|---|---|
| 3,192,669 | 7/1965 | Hawkins | 52/81 |
| 3,791,088 | 2/1974 | Sandow et al. | 52/200 |
| 3,844,087 | 10/1974 | Schultz et al. | 52/200 |
| 3,921,352 | 11/1975 | Koopman et al. | 52/200 |
| 3,945,160 | 3/1976 | Grosser et al. | 52/81 |
| 3,999,336 | 12/1976 | Bance | 52/80 |
| 4,021,987 | 5/1977 | Schnebel et al. | 52/235 |
| 4,050,201 | 9/1977 | Hubbard et al. | 52/209 |
| 4,114,330 | 9/1978 | Sukolics | 52/200 |
| 4,123,883 | 11/1978 | Barber, Jr. et al. | 52/200 |
| 4,194,325 | 3/1980 | Chaplin, Jr. | 52/14 |

FOREIGN PATENT DOCUMENTS

| | | | |
|---|---|---|---|
| 913773 | 12/1962 | United Kingdom | 52/235 |

*Primary Examiner*—John E. Murtagh
*Assistant Examiner*—Andrew Joseph Rudy
*Attorney, Agent, or Firm*—Fitch, Even, Tabin & Flannery

[57] ABSTRACT

A skylight system is formed of preglazed modules which are arranged side-by-side in a grid-like array which is supported on an underlying beam structure. The preglazed modules have slideably interfitting edges for joining to adjacent modules along all four sides of each module. The preferred modules are attached and are supported on corners thereof to the underlying beam structure. The interfitted edges allow slight relative shifting to accommodate expansion or contraction due to thermal conditions. Preferably, the modules may be supported and arrayed to define a flat surface or a predetermined curvature for the skylight. Broken glazing panels may be replaced in a given preglazed module. Gutters on adjacent modules are joined to provide a continuous moisture removal system.

16 Claims, 7 Drawing Figures

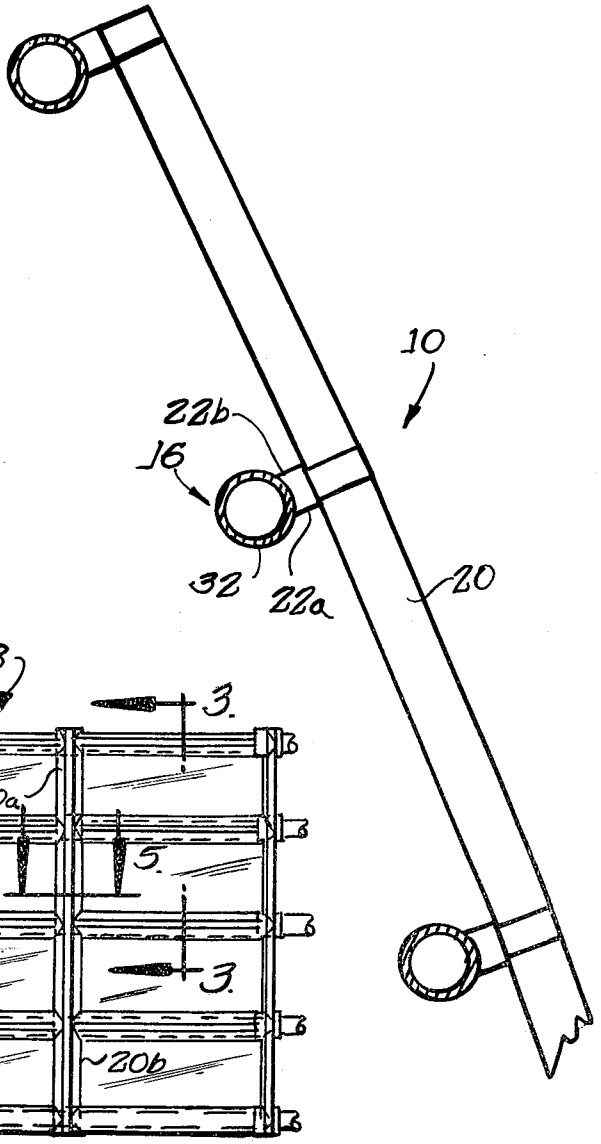
Fig. 3.
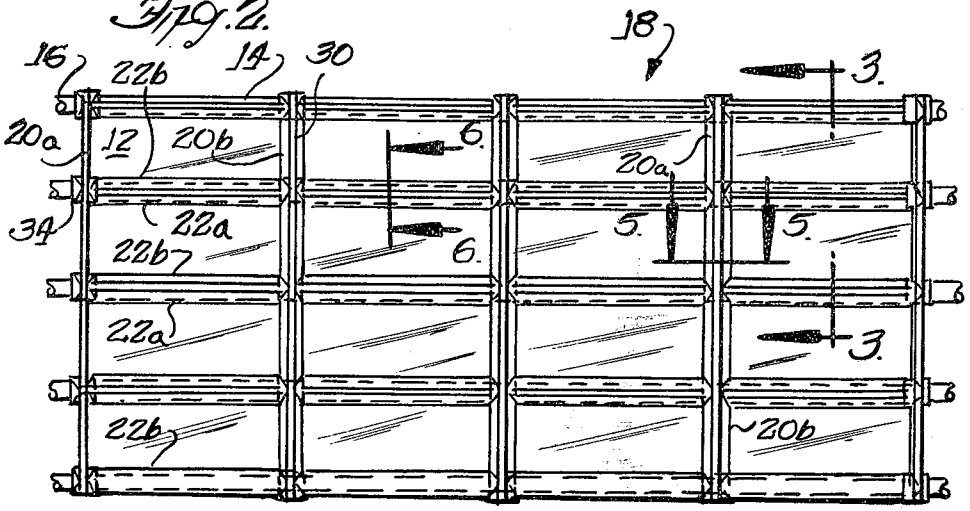
Fig. 2.
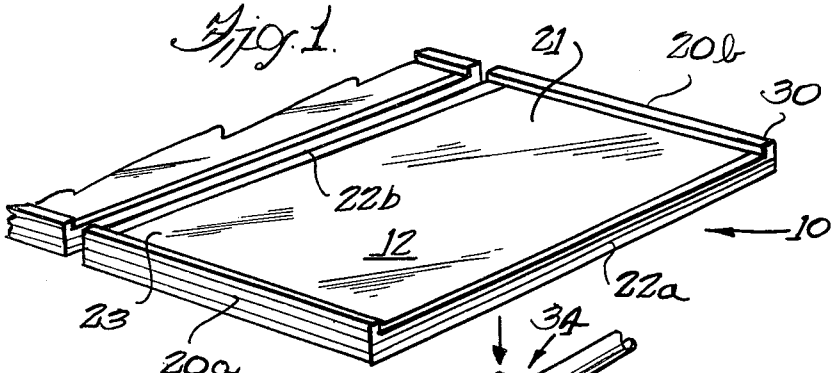
Fig. 1.
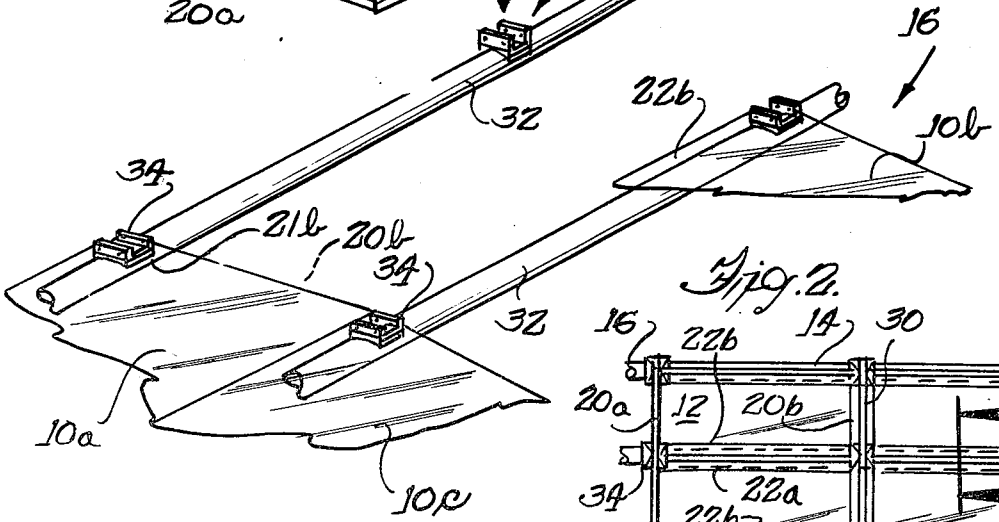

12A
30
120b
122
120a
14
220
140
116
12
210
116
110
114
66a
24a
66b
114
12
118
118
208
112b
201
196
198
196
95
199
112a
106
206
106
100
104a
102
104b
92b
192a
93
92a
20a
90
94
138
130
194
82
84b
98
212
96
20b
25A
86a
251
82b
253
256
60b
60a
204
212
132
86b
88
28
58
84a
73
71
80
128
203
203
26
22b
56
72
50
74b
52
70
74a
54
54
34
48
55
44
42
46
40
16
48
36
32

30
14
220
24b
106
174
67a
67b
22a
114
118
170
22b
140
210
12
192b
201
198
196
199
95
106
112c
104c
206
93
169
171
208
112d
104d
19A
192a
92c
156
95
93
152
266
168
162
164
180
92d
269
256
86
177
22b
167
22a
251
184
61b
86d
88
20A
260
86c
28
88
58
88
154
162
166
164
266
212
160
158
178
88
56
20a
70
72
52
59
54
50
26
34
42
55
46
44
36
16
38
48
40
32

10
22b
160a
164a
162a
158a
324
326
316
318
300
320
322
32
34
304
302
306
308
310
312

UNITIZED SKYLIGHT STRUCTURE

The present invention relates to skylight or glass wall structures particularly useful as roofs of large buildings or as covering large atrium spaces and to the method of constructing the same.

More specifically, the present invention is directed to a skylight system useable as a roof-like structure for an atrium or for the top of a building as distinguished from a curtain wall or facia of a building. Such skylight systems may be expected to carry relatively heavy loads and to have systems for removing condensate or water leakage. For instance, heavy snow, ice or other loads may be present on the roof or the atrium. Also, window washing equipment often must be supported on the roof or atrium skylight structure.

Heretofore, skylight systems for this kind of use have been erected with individual rafters and purlins being built into gridwork on the job site and then later glazing panels are installed into the purlin and rafter gridwork. The present invention is directed to the elimination of the need for such preassembly of a rafter and purlin gridwork by using preglazed modules or units which are preassembled at another location such as a factory and shipped to the job site for erection directly onto a supporting structure.

A typical support structure for an atrium in a large office building includes a series of beams extending parallel fashion in a given direction, for example, generally vertically or horizontally with few or no cross beams. Such beams are considerably larger than glazing support members such as purlins and rafters, and hence, it would be very costly to make an underlying beam support into a gridwork to support the glazing panels. Also, the aesthetics would be adversely effected. Usually, the glazing panels used for such atrium or the roofs have a maximum size of about 4 feet by 9 feet or, 5 feet by 10 feet, and hence, large beams would not be used in a manner to provide direct support for the glazing panels. When using preglazed modules they should be assembled in the skylight so as to allow for expansion or contraction due to thermal loading. Also, the skylight should not creak or make noise if it experiences wind or other dynamic loadings. Further, breakage of glass panels sometimes occurs and it is most desirable that the preglazed assemblies be designed to allow replacement of a broken glazing panel. Of course, such skylight systems should be sealed to be relatively weatherproof and have condensate removal systems for draining away condensate or water leaking past a seal.

In many instances, the designer of the atrium, or roof desires to provide a curve or arcuate configuration for the structure. Since the sheets of glass are relatively large and flat, the skylight system using preglazed modules should be designed to allow an angular relationship between adjacent preglazed modules to accommodate the desired curvature for the entire roof or atrium.

Accordingly, a general object of the present invention is to provide a new and improved skylight system and or preglazed modules which may be used as a roof or an atrium wall.

The further object of the invention is to provide a method of making skylight system which will overcome the problems above-described.

These and other objects and advantages of the invention will become more apparent from the following detailed description of the invention in reference to the accompanying drawings in which:

FIG. 1 is an exploded perspective view of a skylight module and a portion of a structural framework which supports such modules;

FIG. 2 is a plan view of an array of modules of FIG. 1 interconnected and supported by the structural framework to form a skylight protion;

FIG. 3 is an enlarged cross-sectional view taken along line 3—3 of FIG. 2;

DETAILED DESCRIPTION OF THE INVENTION

Figure 4:
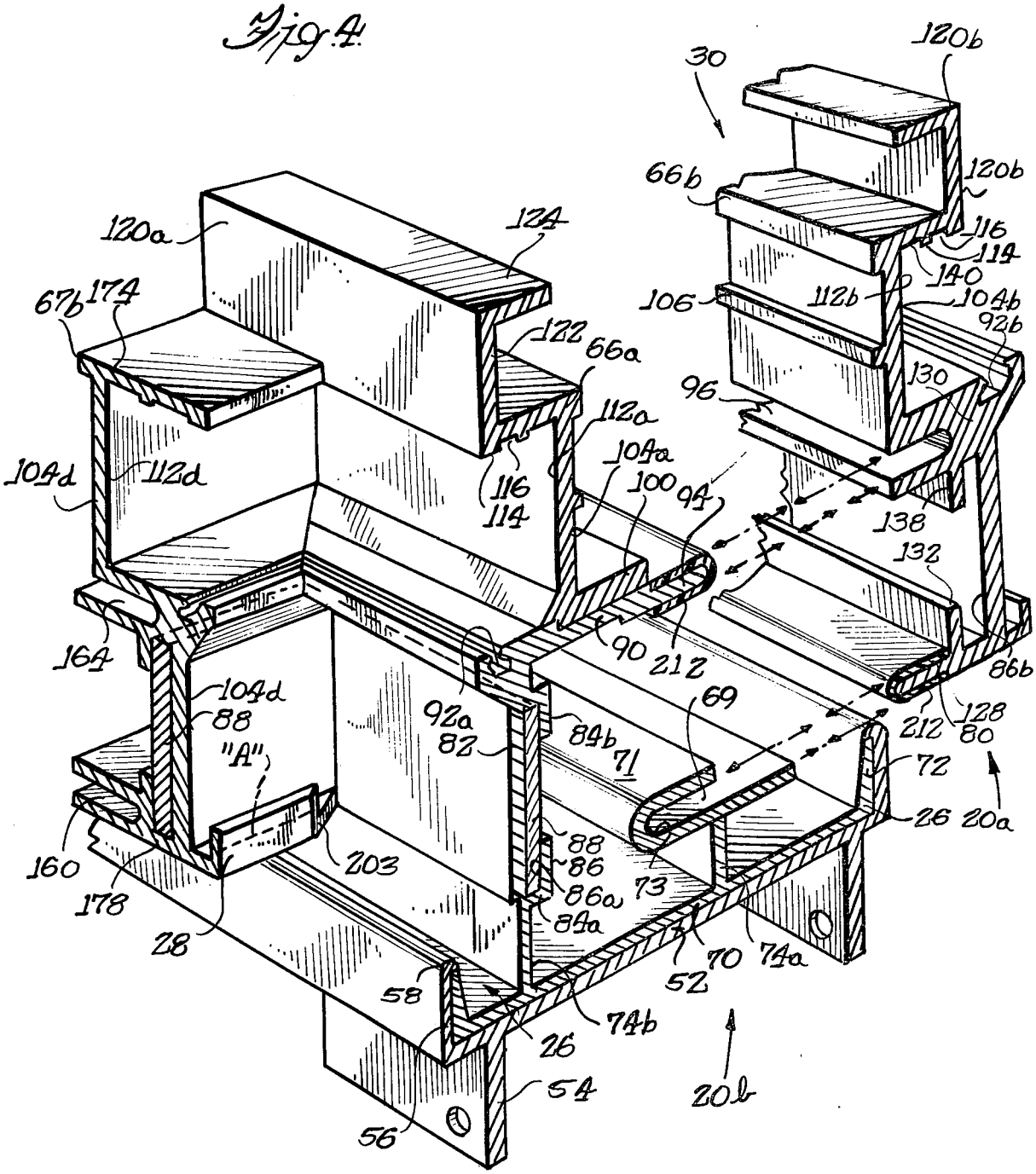
FIG. 4 is an enlarged fragmentary view showing a corner of a glazing module and the interfitting relationship between adjacent modules.

As shown in the drawings for purposes of illustration, the present invention is directed to a preglazed module 10 (FIG. 1) having a glazing panel 12 preferably in the form of a large flat sheet of glass having a size about 5 feet by 10 feet. The preglazed modules 10 are supported on an underlying supporting framework 16 typically made of large support beams 32. The preglazed modules are arranged in a grid-like array to form a skylight system 18 with the preglazed modules being interconnected with one another and with the underlying support framework 16. Herein, the underlying support framework 16 is formed with a plurality of parallel support beams 32, as shown in FIGS. 1–3, in the form of circular pipes extending horizontally and parallel to each other. Although the parallel beams 32 are in the form of circular tubes or pipes, other shapes may be used for the supporting framework 16.

Usually the supporting beams 32 will be spaced apart a distance about equal to the width or height of the glazed panels. For instance, the beams 32 illustrated herein are spaced at about 5 feet intervals with the glazing modules 10 having vertical height of 5 feet and a horizontal width of about 10 feet. In the framework 16 shown in FIGS. 1–3 there are no vertically extending beams. Of course, suitable cross or vertical beams may be provided, if desired, between the horizontal beams 32 at suitable locations to provide additional strength and rigidity. However, there is no need for, in fact, it is usually not desired to have the large beams extend in a grid-like pattern because of the expense and the aesthetics. It is, of course, to be realized that the beams 32 may be arranged parallel to each other in a vertical direction and disposed at 10 feet intervals rather than the being disposed horizontally and at 5 feet intervals as illustrated herein. Also, the dimensions may be changed from that given herein.

As typical with skylight systems, a condensate or water removal system is provided to collect condensate condensing on the inside surface of the glazing panels 12 and to collect moisture leaking through an imperfect seal. The condensate removal system drains the water away without its dripping into the interior space. Herein, the unitized individual preglazed modules 10 are interconnected in a manner that their respective individual vertically extending, condensate channels or gutters 26 (FIG. 4) on the vertical frame members 20 convey the collected water from one to another to convey the water in a downward direction to a discharge point (not shown). The preferred horizontal frame members 22 of the preglazed modules also have a condensate or gutter channel 28 which extends at least across the lower side of the module to carry condensate or moisture laterally and to discharge the moisture into an underlying gutter segment 26. For instance, as shown in FIG. 4 by the dotted arrows "A", water may flow through the horizontal gutter 28 to discharge at an end 203 thereof to drop downwardly into the underlying vertically extending gutter 26 which then carries the moisture downward.

As will now be explaned in connection with FIG. 1, the preglazed module 10 shown in full in FIG. 1 will be described as being fitted with and interconnected with adjacent preglazed modules 10*a* and 10*b* which are already mounted on the pair of supporting beams 32 shown in FIG. 1. As will be explained in greater detail hereinafter, each of the four sides 20*a*, 20*b*, 22*a* and 22*b* of the preglazed module has an interlocking portion which is slideable into interlocking relationship with other adjacent modules so as to provide an interlocked gridwork of glazed modules having support frames connected at spaced intervals to the underlying beams. In the arrangement shown in FIG. 1 the lower horizontal frame member 22*a* of the module 10 will be slid into interlocking engagement with the upper horizontal support member 22*b* into already assembled preglazed assembly 10*b*. Also, the preglazed module 10 will be slid to the left as viewed in FIG. 1 to interlock the left vertical support member 20*a* on module 10 with the right support vertical member 20*b* of the already assembled glazing module 10*a*. The remaining connection is to take the freehand corner 21 of the module 10 and to connect it to a corner support means which comprises a bracket means 34 which underlies the same as shown by the direction arrow as shown in FIG. 1. As will be explained in greater detail hereinafter, the preferred interconnection includes a weld between the module corner 21 and the underlying bracket means 34, although other fastening means could be used. Also, as will be explained in greater detail hereinafter, a "T-shaped" member 250 is then positioned betweeen the upper left hand corner 23 of the module and the upper right hand corner 21*b* of the preglazed module 10*a*. Thus, in this preferred embodiment of the invention each preglazed module 10 is secured at its upper two corners by means in addition to the sliding interfitted relationship it has along its vertical edges 20*a*, 20*b* and its horizontal edges 22*a*, 22*b*.

Figure 5:
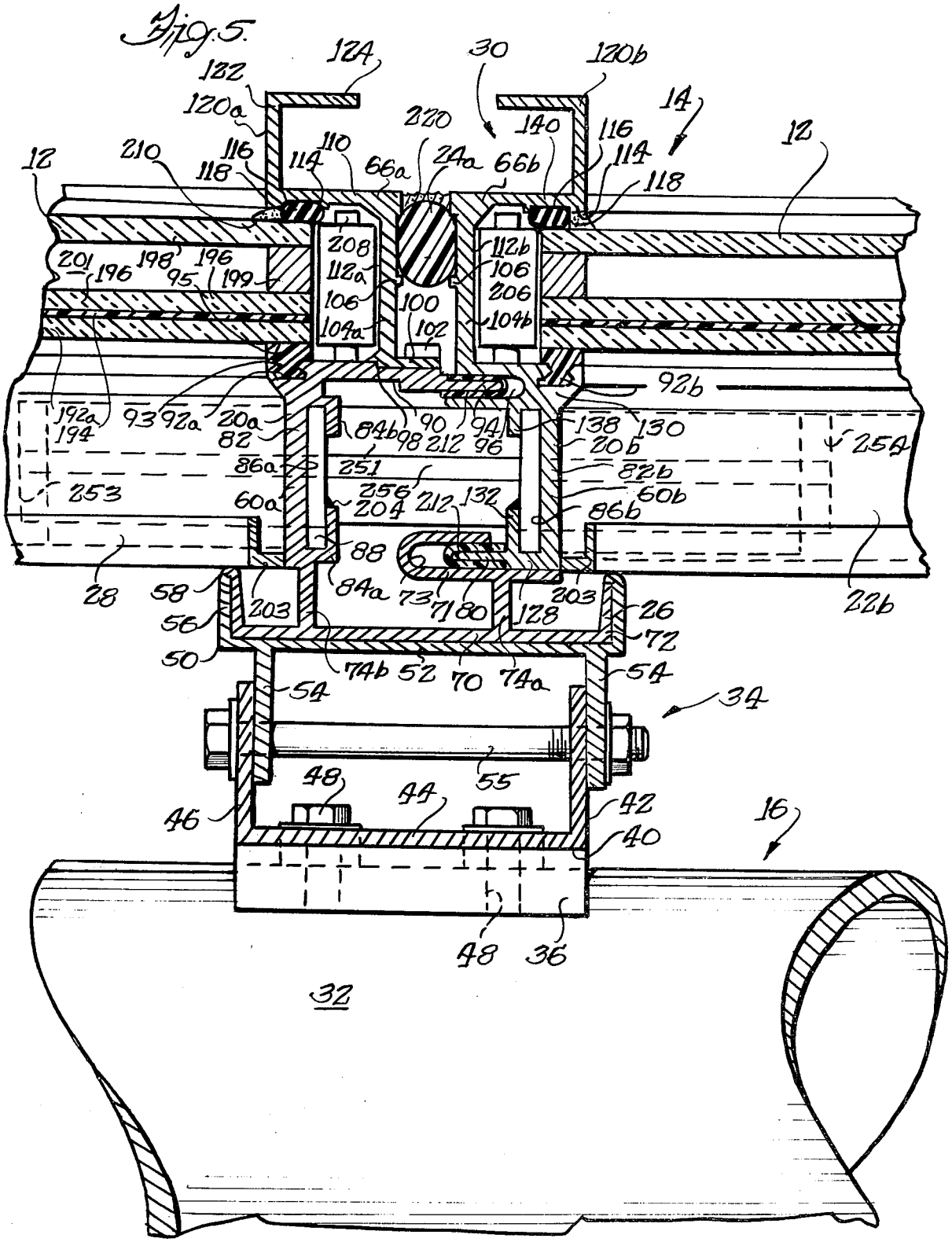
FIG. 5 is a greatly enlarged cross-sectional view taken along line 5—5 of FIG. 2
Figure 6:
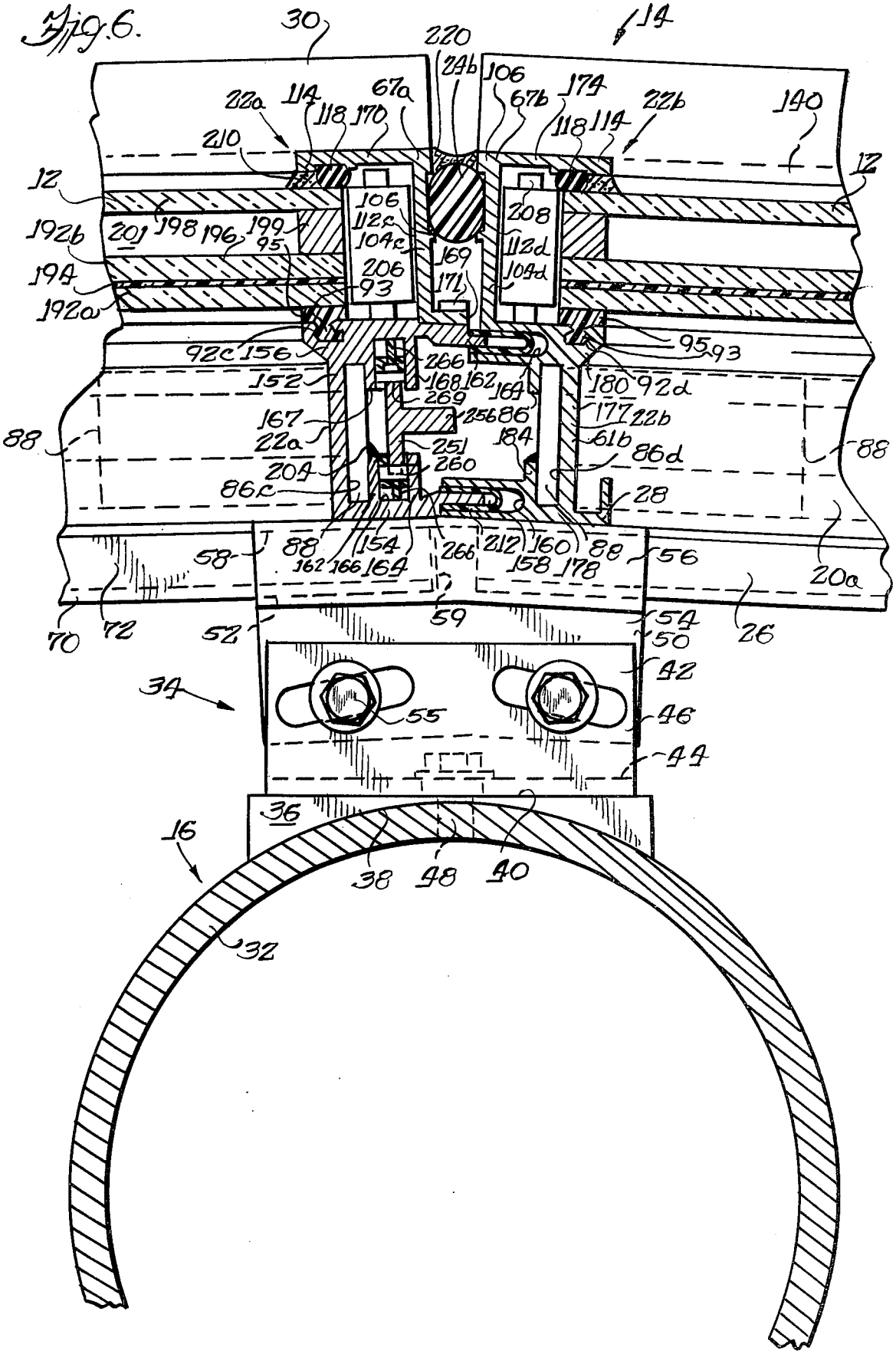
FIG. 6 is a greatly enlarged cross-sectional view taken along line 6—6 of FIG. 2.

The preferred construction resulting in the interfitted relationship between adjacent modules can be most readily understood from a review of FIG. 4 in which a lower projection 80 on a left hand vertical member 20*a* is slid into a slot 69 on the right hand vertical member 20*b*. The preferred sliding interlocking means includes a second means having a laterally projecting flange 94, on a right vertical member which, as shown by the arrows, is slid into the accommodating slot 96 on the left vertical member 20*a*. Similar interlocking slot and slideable interlocking flanges are presented on all four sides of each of the glazing modules as will be described in the detailed description hereinafter. As can be seen in FIGS. 5 and 6, a gap is provided within the slots to allow individual expansion or contraction of the projecting flanges. Thus, the modules can accommodate expansion or contraction in different directions with the projecting flanges merely sliding in their receiving slots.

After several of the modules have been assembled into an array and before the entire roof or skylight structure is assembled, it is possible to make the partially assembled array weather tight by inserting the weather strips 24*a* and 24*b*, as shown in FIGS. 5 and 6 between adjacent frame members of adjacent modules. The preformed and compressed weather strip seals 24*a* and 24*b* are preferably then overlayed with their respective caulk sealant 220 and 72.

In the preferred embodiment of the invention, a glazing panel 12 may be removed if the same were broken in a preglazed module 10 by removal of the caulk 72, 220 and removably glazing strips 66*a* and 67*b*. Removal of the sealing strip 24*b* allows access to a fastener 171 (FIG. 6) which holds down an outer glazing strip 67*a* to an inner underlying glazing strip. In a like manner, as shown in FIG. 5, the removal of the caulking 220 and the seal 24*a* exposes a threaded fastener 102 which may be removed so that one may lift up the outer glazing strip 66*a* from the top of the glazing panel 12. By removing the glazing strips 66*a* and 67*a* at a given corner of a module, the glazing panel 12 may be slid outwardly from the remaining two glazing strips and then lifted upwardly for removal. In a like manner, a new glazing panel 12 may be positioned and then slid inwardly into position with the glazing strips 67*a* and 67*b* being reapplied and refastened into position. Then the caulking and weather strips may be reapplied. This particular construction will also be described in greater detail hereinafter.

In the illustrated embodiment of the invention, the skylight will be provided with a large curved surface with the curvature being in the vertical direction, as seen in FIG. 6, with the vertical support members 20*a* and 20*b* being pitched at an angle of 2 ¼ degrees from a plane normal to a radius extending inwardly through the gap between adjacent modules and through the pipe beam 32. It is clear in FIG. 6, that the left and right hand glazing panels 12 are not coplanar and that their respective planes will intersect in the gap and at a particular angle. Herein that angle is called the segment angle. In this embodiment of the invention, each of the modules will be disposed at the same segment angle so that the modules will define a continually changing curvature of the same radius. Herein, the interconnection between adjacent modules is provided by bending the interlocking flanges 162 and 158 at a 4 ½ degree angle from the plane of their associated glazing panels 12, as will be described in greater detail hereinafter.

So that the invention will be more fully understood, the modular skylight array 18 will now be described in greater detail.

In the illustrated embodiment, the structural framework 16 is provided interior of the skylight modules 10 holding the skylight modules thereabove. The structural framework 16 is formed of a plurality of beam members, herein tubes on pipes 32, running parallel to each other and along rows of interfitted horizontal frame members 22. The tubes 32 are a building component adjusted to carry an atrium like skylight or a roof like skylight. It is to be understood that the illustrated support framework 16 represents only one of many possible structural frameworks which may be used to support the modular array of the present invention: the tubes might be replaced by I beams or other shapes; the support tubes or beams might run along the lateral members or a lattice of support beams might be used where greater structural strength is required.

As a means to provide for attachment of the modules 10 to the tubes 32, bracket means sometimes hereinafter referred to as bracket assemblies 34 are secured at spaced intervals, herein, generally the length of the horizontal frame member 22, along the tubes. The bracket assemblies 34 serve as corner supports in that each of the modules 10 is supported at its four corners by a bracket assembly 34. The bracket assemblies 34 include an adapting bracket 36, (FIG. 6) having an arcuate underside 38 matched to the cylindrical surface of the tube and a flat upper surface 40, is laid over the tube. A channel bracket 42 having a flat bottom 44 and a pair of upstanding flanges 46 perpendicular to the axis of the tube, is laid over the adapting bracket 46. The adapting bracket 46 and channel bracket are jointly attached to the tube by a pair of bolts 48.

Figure 7:
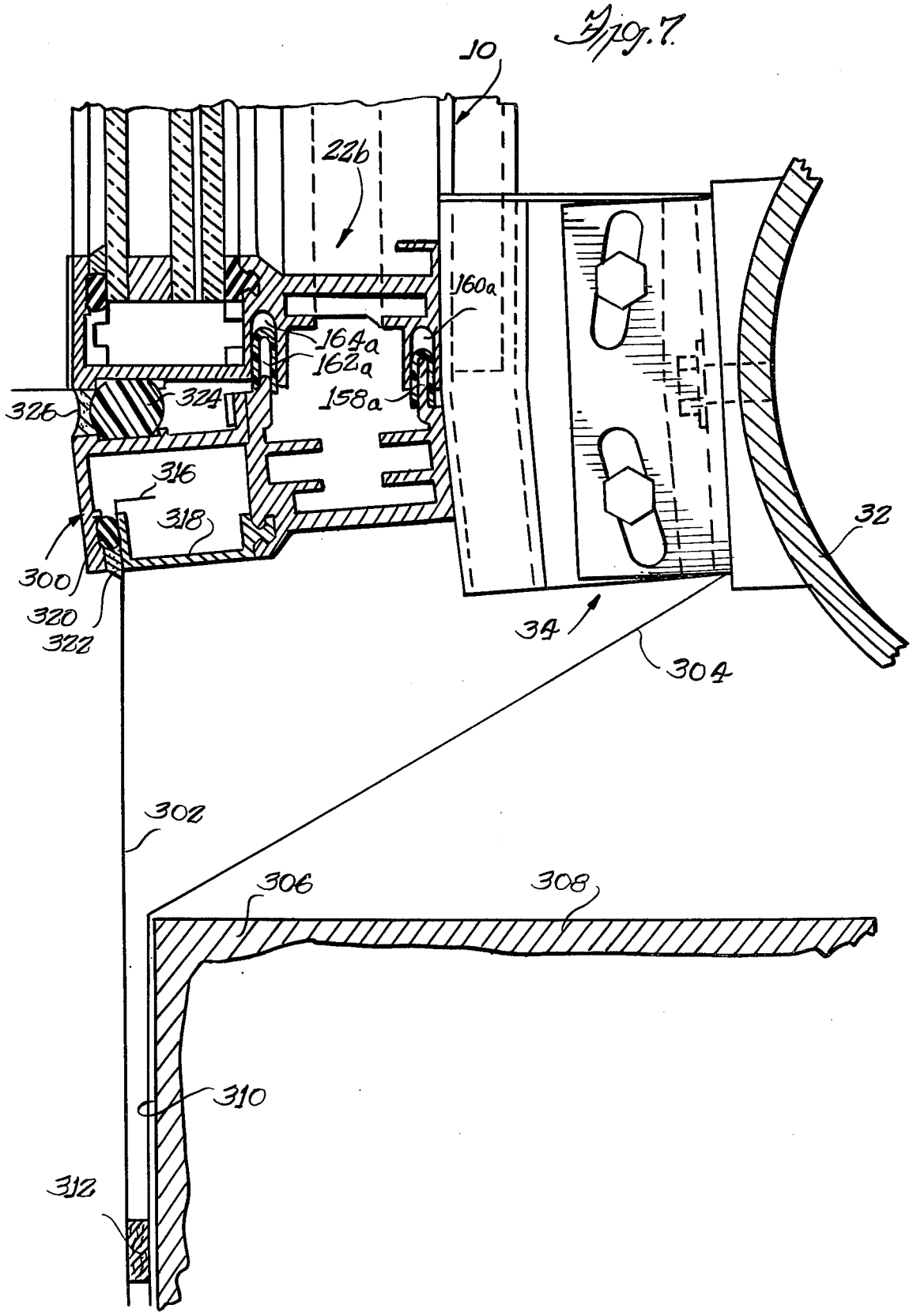
FIG. 7 is an enlarged cross-sectional view of an edge of the skylight system being joined to a building.

The bracket assembly 34 also includes a platform bracket 50, into which are slid cooperating portions of the module frames 14, is carried by the channel bracket 42. The platform bracket 50 has a base 52, a pair of depending flanges 54, which are attached by horizontal bolts 55 to the upstanding flanges 46 of the channel bracket 42, and a pair of sidewalls 56 extending upward from the base. Each sidewall 56 has a lip 58, as best seen in FIG. 7, extending inwardly from its upper end to overly and hold down a frame member 20*a* or 20*b*.

The frame 14 of the module 10 is preferably formed of the extruded aluminum members 20, 22. With references to the drawings, the vertical frame members 20 may be thought of as rafters of the skylight 18, and the lower members 22 may be thought of as purlins interconnecting the rafters. The terms are used interchangeably herein. Two types of vertical members 20*a*, 20*b* are used, one type interfitting with the other, and herein, the two types will be referred to as left vertical members 20*a* and right vertical members 20*b* with reference to the orientation of FIG. 5. Similarly, two types of horizontal members are used, one type interfitting with the other, and herein they will be referred to as lower horizontal member 22*a* and upper horizontal member 22*b* with reference to the orientation of the frame FIG. 6. The frame 14 of each module 10 comprises a left and a right vertical member 20*a*, 20*b* and a lower and upper horizontal member 22*a*, 22*b*. Each vertical member 20 and each horizontal member 22 includes a lower body portion 60, 61 including gutter segments 26, 28 and an upper portion 66, 67 which receives the glazing panel 12. As a means of inserting the glazing panel 12 in the frame 14, the upper glazing porions 66*a*, 67*a* of the left vertical member 20*a* and left horizontal member 22*a* are formed separate from the body portions 60*a*, 61*a* and attached to the body portions after insertion of the glazing panel 12.

The body portion 60*a* of the left rafter 20*a* provides a segment 26 of the gutter structure by which water is conveyed from one module 10 to another to the edge of the skylight structure. The gutter segment 26 also provides the means of attaching the modules to the platform brackets 50.

The gutter segment 26 includes a bottom plate 70 and a pair of upstanding sidewalls 72. The bottom plate 70 and sidewalls 72 are proportioned to slide into the platform brackets 50 with the bottom plate 70 resting on the base plate 52 and the gutter segment sidewalls 72 closely adjacent the platform sidewalls 56 and extending upward to the sidewall lips 58. Where the skylight 18 is inclined, the lower of a pair of rafter ends is generally welded 59 to hold the lower module from sliding down in a water-tight fashion to the platform bracket 50 as shown in FIG. 6. As seen in FIG. 6, the water will be flowing from right to left and across the gap between adjacent gutter ends on the respective rafters. The welded attachment at one end of the left vertical member 20*a* generally provides the only immobilized connection for each given module 10 to the structural framework 16, and by this single immobolized connection, the module 10 is positioned in the modular skylight structure. The other upper end of the module is attached by a T-shaped key to an adjacent module, as will be explained in greater detail. The lower of the pair of ends are unattached and free to slide within the platform bracket 50 whereby continuous downhill gutter channels are provided while shifting of adjacent modules is permitted to allow for thermal contraction and expansion.

A flange 74*a* extends upward from the bottom plate 70 of the left rafter 26 gutter structure toward its outer (right) side and carries an outwardly facing, U-shaped piece 71 which provides a U-shaped recess 73 into which is slid a protrusion 80 of the right rafter 20*b*. Another flange 74*b* extends upward from the bottom 20 of the left rafter 20*a* towards its inner side and carries a body wall 82.

At each of the four corners of a preglazed module, the adjacent ends of the respective purlins and rafters are joined together by an angle 88 which is slid into a guideway or track formed on each rafter and purlin. As viewed in FIG. 5, the body wall 82 has a pair of angle pieces 84*a*, 84*b* on its outwardly facing (right) side, a lower angle piece 84*a* having its free section pointing upward and an upper angle piece 84*b* having its free section pointing downward whereby the angle members provide a track 86*a* for a rafter-purlin interconnecting angle member 88. Thus, the four corners of the rafters and purlins of each module are joined at a corner by an angle 88.

At the upper end of the body wall, a horizontal central piece 90 provides an upwardly facing groove 92*a* for receiving a tongue 93 of a lower glazing gasket 95 that forms a seal along the edge of the glazing panel 12 carried thereontop. The central piece 90 also provides an end protrusion 94 to be slide into a U-shaped recess 96 of the right rafter 20*b* and an upper ridge 98 which receives a connecting flange 100 of the glazing portion 66*a* of the left rafter.

The purlin and rafter members 20*a* and 22*a* each have a detachable outer glazing strip which overlies an edge of the glazing panel 12 to lock the same to its associated purlin or rafter. As best seen in FIG. 5, an upper glazing strip 66*a* for the left rafter 20*a* is attached to the lower body portion 60*a* by bolts 102 holding the connecting flange 100 to the central piece 90. A glazing panel backing wall 104*a* extends upward from the inner side of the connecting flange 100. A pair of spaced-apart ridges 106 on the outer surface of the backing wall 104*a* cooperate with similar ridges on a backing wall 104*b* of the right rafter 20*b* to hold the resilient weather strip 24*a* therebetween.

From the upper end of the backing wall 104*a*, a top piece 110 extends inward (to the left) to provide with the central piece 90 of the body portion 60*a* a channel 112*a* in which the glazing panel 12 is received. The top piece 110 has a pair of downwardly depending ridges 114 providing a groove 116 in which a segment of upper glazing gasket 118, that extends along the periphery of the glazing panel 12, is received.

The top piece 110 also carries at its inner (left) edge an angle piece 120*a* having an upstanding section 122 and an outwardly extending section 124 which, along with a facing angle piece 120*b* of the right rafter, provides the track 30 in which a window washing device may be conveyed across the skylight washing several modules in its sweep.

The right rafter 20*b* is formed as a unitary structure with an edge of the glazing panel being slid laterally therein (FIG. 5). The body portion 60*b* includes a body wall 82*b* and a lower piece 128 and central piece 130 extending outwardly (to the left) therefrom. The lower piece 128 has an upstanding flange 132 which forms one-half of rafter-purlin interconnection track 86*b*, and the horizontal protrusion 80 which slides into in the U-shaped recess 73 of the left rafter 20*a*. The central piece 130 provides an upwardly facing groove 92*b* which receives a segment of the depending tongue 93 of the lower glazing panel gasket 95 and the outwardly facing U-shaped recess 96 in which the protrusion 94 of the left rafter 20*a* is received. A short flange 138 depends from the central piece providing the other half of the rafter-purlin interconnection track 86*b*.

The upper glazing portion 66*b* of the right rafter 20*b* includes a backing wall 104*b* extending upward from the outer edge of the central piece 120 and a top piece 140 that forms with the central piece a channel 112*b* for receiving the glazing panel 12. A pair of ridges 114 depend from the top piece provide a groove 116 in which a segment of the upper glazing gasket 118 is received. The top piece 140 also carries, at its outer edge, the angle piece 120*b* which forms the other half of the window washing track 30.

Referring now in greater detail to the right and left purlin 22*a*, 22*b*, shown in FIG. 6, the lower edges of the purlins are at the level of the upper edges of the platform bracket sidewalls 56 whereby water drains from the purlin gutter segments 28 to the elongated gutter channels formed by interconnected rafter gutter segments 26. Although the purlins 22 are illustrated in FIG. 6 generally horizontal, the interfitted purlins 22*a*, 22*b* in the particular embodiment is for a structure in which the interfitted modules 10 are sloped upward (to the right), and in this embodiment, only the right purlin 22*b* has the gutter segment 28 to catch downwardly flowing water.

The body portion 61*a* of the left purlin includes an inner body wall 152, an outwardly extending lower piece 154 and an outwardly extending central piece 156. The lower piece 154 has an outwardly extending protrusion 158 for sliding into an interfit with a U-shaped recess 160 of the right purlin 226 and a pair of upwardly extending flanges 162, 164. The inner flange 162 provides one-half of a purlin-rafter interfitting track 86*c*, and the outer flange 164 provides one half of a key track 166. The central piece 156 provides an upwardly facing groove 92*c* at its inner (left) end for receiving a segment of the tongue 93 of the lower glazing gasket 95, an outwardly facing protrusion 162 for sliding interfit with a U-shaped upper recess 164 in the right purlin 22*b* and a pair of depending flanges 167, 168 which complete the other halves of the purlin-rafter interfitting and key tracks 86*c*, 166.

The upper removable glazing strip 67*a* of the left purlin 22*a* includes a connecting flange 169 by which it is attached by bolts 171 to the central body piece 156, an upstanding backing wall 104*c* and a top piece 170 extending inwardly from the backing wall to provide with the central piece a channel 112*c* for receiving the glazing panel 12. The top pieces 170, 174 of the purlins 22 are generally flush with the top pieces 110, 140 of the rafters 20, and the window washing tracks 30 carried by the rafters extend thereabove. The backing wall 104*c* has a pair of ridges 106 extending from its outer side which together with a pair of ridges 106 on a backing wall 104*d* of the right purlin 22*b* hold the weather strip 24*b*. A pair of ridges 114 depend from the top piece 170 for holding a segment of the upper glazing gasket 118.

The lower body portion 61*b* of the intergal right purlin 22*b* includes a body wall 177, the inwardly extending purlin gutter segment 28, an outwardly extending lower piece 178 and an outwardly extending central piece 180. The lower and central pieces 178, 180 provide the outwardly (to the left) facing U-shaped recesses 160, 164 which receive the corresponding protrusion 158, 162 of the left purlin 22*a*. An upwardly extending flange 184 on the lower piece 178 and a depending flange 186 of the central piece 180 provide a rafter-purlin interconnection track 86*d*. The central piece 180 also has an upwardly facing groove 92*d* for receiving a segment of the tongue 93 of the lower glazing gasket 95.

The upper glazing portion 67*b* includes the backing wall 104*d* and the top piece 174 extending inward therefrom. The backing wall 104*d* has the pair of ridges 106 which help hold the weather strip 24*b*, and the top piece 174 has a pair of depending ridges 114 for holding a segment of the upper glazing gasket 118.

The preferred glazing panel 12 for use in the module 10 has safety and insulating features. Two sheets of glass 192*a*, 192*b*, bonded by a clear plastic material 194 comprise a lower panel 196. The resinous material 194 prevents glass from spraying into the interior regions of the building if the glazing panel is broken. A single sheet of glass comprises an upper panel 198, which is spaced from the lower panel by a sealing spacer 199. The dead air space 201 between the panels 196, 198, of course, serves an insulating function.

Moving clockwise around a typical module frame 14, a typical rafter-purlin sequence is a left or lower purlin 22*a*, a left rafter 20*a*, an upper or right purlin 22*b* and a right rafter 20*b*. With reference to FIG. 2, the lower purlin 22*b* with its gutter segment 28 is to the bottom of the incline in each module 10. The rafter segments 22 are joined end-to-end whereby the rafter segments 62 provide continuous drainage channels and the washing tracks segments 30 provide continuous track structures. The purlins 22, on the other hand, abut the rafters at their ends with the ends of the purlin gutter segments 28 extending over the sidewalls 72 of the rafter gutter segments 26. As seen in FIG. 5, the purlin gutter segment 28 is shortened at its end 203 to facilitate drainage of water into the rafter gutter segments 26.

The frame 14 is constructed by initially joining body portions of the right rafters 20*b* and purlins 22*b* to the body portion of the left rafter 20*a* and purlin 22*a*. The rafters and purlins are interconnected at the four corners by means of four angles 88 having one section inserted into the interconnection track 86*a*, *b* of a rafter 20 and one section inserted into the interconnection track 86*c*, *d* of a purlin 26. After insertion, the angle pieces 88 are welded 204 to the respective frame members to securely connect the purlins 22 and rafters 20.

The tongue 93 of the rectangular lower glazing gasket 95 is inserted into the upwardly facing grooves 92 of the interconnected frame members. Because the glazing portions 66*a*, 67*a* of the left rafter 20*a* and left purlin 22*b* have not been applied to the body portions 60*a*, 61*a*, the glazing panel 12 is inserted by lowering it into the upper side of the frame and sliding it into the glazing channels 112*b*, 112*d* of the right rafter 66*b* and right purlin 67*b*. Spacing blocks 206 of resilient material, e.g., neoprene are inserted into the corners of the glazing channels prior to insertion of the glazing panel to space the glazing panel from the backing walls 104. The spacing blocks 206 cushion the glazing panel and provide for different thermal expansion of the frames 14 and glazing panel 12. The spacing blocks 206 have upper and lower protuberances 208 which extend the blocks between the central pieces and top pieces that define the glazing channels 112.

After the glazing panel 12 has been inserted, the frame 14 is capped by bolting the removable glazing strips 66*a*, 67*a* of the left rafter 20*a* and left purlin 22*a* to the respective body portions 60*a*, 61*a*. The upper glazing gasket 118 is pressed into the groves 116 provided by the depending ridges 114 of the top pieces, and caulking 210 is applied along the upper edges of the glazing panel.

To construct a skylight with modules of the present invention, the structural framework 16 is preassembled. Care is taken in the spacing of the parallel tubes 32 and in the spacing of the bracket assemblies 34 to provide a bracket assembly i.e. a corner support at each corner of each module 10. Each left rafter 20*a* is slid approximately halfway into a platform bracket 50 at each end whereby each pair of end-to-end left rafters is joined by a common platform bracket as seen in FIG. 6. Adjacent rafters 20 and purlins 22 are joined together by sliding them relative to each other so that their interfitting flanges mate with their corresponding U-shaped recesses.

As seen in FIGS. 5 and 6, preferably the flanges 158, 162, 80 and 94 are considerably thinner than the respective recesses, and U-shaped strips 212 of resilient material are applied to these flanges 158, 162, 80 and 94 before insertion into the recesses whereby seals are formed between the protrusions and recesses. The strips 212 prevent squeaking and also assist in allowing expansion and contraction with thermal changes.

The interfitting arrangement provides for the modules 10 to be joined together with good weather-proof sealing between adjacent modules, but also provides for some sliding movement between adjacent modules to accommodate thermal expansion and contraction. Adjacent modules are held together only by cooperation of the interfitted flanges and recesses and may pull together or spread apart slightly as the need may be. The weather strips 24, which provide the primary sealing between adjacent frame members are resilient enough to maintain their seal during such lateral shifting. Furthermore, the resilient U-shaped strips 212, carried by the flanges, provide, with the corresponding recesses, secondary sealing between adjacent modules 10, which secondary sealing is maintained throughout shifting.

Because, generally only one end 21 of each module is permanently secured to a platform bracket 50, shifting is permitted in the lateral as well as the longitudional directions with respect to FIG. 2. Of course, it is not intended that the modules shift to any great extent relative to each other, and the modular construction assures that thermal effects are generally evenly distributed between all module interfittings rather than concentrated at certain locations as is typically the case in skylights of a unitary frame type construction. Accommodation of thermal effects becomes increasingly important as the size of the skylight structure increases. As a further consequence of the sliding interfit between adjacent modules, some tolerance is provided in assemblying the array of modules, slight misalignment of mounting brackets being corrected by the depth to which the protrusions are inserted into the corresponding recesses.

At each corner 23, the T-shaped key 250 is slid into place to interlock three adjacent modules meeting at the corner. As best seen in FIG. 5, the key includes a straight leg or bar 251 which extends across the gap between modules in FIG. 5 and from a left end 253 to a right end 254. A cross bar 256 (FIGS. 5 and 6) on the key projects horizontally and at right angles to the bar 251. The cross bar 256 is short, as seen in FIG. 6, and has a width to project laterally, in FIG. 5, across the gap to abut the angles 88 on the frame members 20*a* and 20*b*. This short cross bar is merely inserted into the gap shown in FIG. 5 to abut the corner angles 88 on adjacent modules. The long bar 251 is preferably fastened such as by pins 260 (FIG. 6) extending through aligned holes in the bar and depending flanges 167 and 168 for the upper pin and aligned holes in the upwardly projecting flanges 162, and 164, which define the key tract 166. As best seen in FIG. 6, the lower and upper horizontal edges of the long bar have gasket strips 264 and 266 thereon to space the key from metal to metal contact with the respective flanges 167, 168 and 164 and 166.

As seen in FIG. 6, the base plate 52 of the illustrated platform bracket 50 is not flat from end-to-end, but rises slightly toward the center to accommodate the segment angle and the arcuate curvature of the skylight. This arrangement provides for a slight angle between one row of skylight modules and another. The angle of about 2 $\frac{1}{4}$° in either direction, is accommodated by the design of the modules 10 without any modification because the resilient weather strips 24 and resilient U-shaped sealing strips 212 provide the necessary sealing even if the modules are not aligned in exactly the same plane.

The skylight is extended to and is enclosed by an encircling frame of members which are to receive the lower, upper, and left and right hand edges of the skylight modules to join them to the surrounding structure. For instance, as will be explained in connection with FIG. 7, a lower frame member 300 extends horizontally along the bottom of the skylight and is attached to the usual bracket means 34 secured to the beam 32 and an exterior extruded aluminum flashing sheet 302 and interior extruded aluminum flashing sheet 304 extending from an upper edge 306 of a vertical building wall 308. More specifically, the lower edges of the flashing sheets 302 and 304 may be brought together along a vertical face 310 of the building wall and suitably joined thereto. Herein, a foam tape 312 of 1 inch thickness is disposed between and adhered to the longitudinally extending edges of these sheets 302 and 304. The foam tape has 0.500 inch wide gaps below the vertical gutters 26 to allow water to flow down from between the sheets 302 and 304 and from the skylight across the vertical face of the building wall 308. The interior flashing sheet 304 extends inwardly and upwardly to be joined at its upper edge to the bracket means 34 at the beam 32. The upper end of the exterior flashing sheet 302 is formed with a right angle flange 316 which is held by a horizontally extending adapter. A suitable sealing strip 320 and caulking 322 seal the upper end of the flashing strip to the frame member 300.

The frame member 300 is made in the shape of a horizontal member 22*a* to match the horizontal members 22*b* on the lower ends of the adjacent modules 10 (FIG. 6). The frame member 300 has upwardly projecting flanges 158*a* and 162*a* in interfitted and slideable relationship with receiving slots 160*a* and 164*a* on the lower edge of the horizontal member 22*b* of the lowermost module 10 of the skylight. A sealing strip 324 is disposed between the lower edge of the module and the upper side of the frame member 300 to provide a horizontally extending seal.

It is to be understood that the other three sides of the skylight may be likewise equipped with an edge frame member similar to frame member 300 for with the other vertical side edges and the top edge of the skylight. Suitable flashing may be used to seal these three other sides of the skylight to the building structure. Thus, it is to be understood that these other frame members have the shapes, respectively, of the other horizontal and vertical members 22*b*, 20*a* and 20*b* to interfit with their associated side frame members on these other three sides of the skylight.

Several advantages of the skylight assembly of the invention should now be more apparent. The modular structure taught herein is easily assembled and can be constructed to generally any size. The modules can be added to the array from any side unlike some previous skylight systems in which a predetermined order of construction must be followed.

The individual modules have thin, lightweight frames which tend to maximize the amount of light-transmitting area and minimize the load on the lattice structure. Each frame is generally firmly attached at one upper corner to the support lattice positioning the module within the modular skylight array and it is keyed to another module at its other upper corner but is permitted by its sliding interfit with adjacent modules to shift slightly relative to the adjacent modules to accommodate thermal effects. The resiliency of the sealing strips maintains the weather-proof barrier despite the limited movement of the modules relative to each other. Furthermore, the sliding interfittings of adjacent modules provides some leeway in fitting adjacent modules and permits the modules to be installed in planes at a very small angle relative to each other. The gutters of the rafters and purlins and the interconnection of end-to-end rafters provide pathways to the edge of the skylight for all moisture which accumulates in the inside of the skylight.

The skylight may be constructed from preglazed panels, a procedure which substantially reduces the time needed to construct the skylight. However, if a glazing panel should break, the glazing panel can be removed with relative ease by removing the removable glazing portions of the left rafter and the left purlin. The washing tracks provided by the rafters facilitate washing of the installed skylight structure.

While the invention has been described in terms of a preferred embodiment, modifications obvious to one with ordinary skill in the art may be made without departing from the scope of the invention.

Various features of the invention are set forth in the following claims.

What is claimed is:

1. A skylight system for installation on an underlying support framework, said skylight system comprising:

a plurality of preglazed modules arranged in a gridwork, each of said preglazed modules having an edge thereof slideably interconnected with adjacent modules, and corner supports at the corners of the preglazed modules extending from the preglazed modules to the underlying support framework, said condensate gutters being formed along vertically extending edges of the preglazed modules and being aligned with one another to transfer condensate downwardly from the skylight system, said condensate gutters being formed along the horizontal edges of the preglazed modules, said horizontal condensate gutters being superimposed over the vertically extending gutters to discharge moisture thereto.

2. A skylight system in accordance with claim 1 in which the slideable interconnect between adjacent preglazed modules comprising a projecting flange extending along the vertical and horizontal sides of the preglazed module and receiving slots for receiving therein the projecting flange of another adjacent module.

3. A skylight system in accordance with claim 2 in which the preglazed modules are formed with straight vertical and horizontal structural members, said projecting flanges and receiving slots being disposed at an angle relative to the straight members to permit adjacent panels to be at an angle relative to each other and to provide a curvature for the skylight system.

4. A skylight system comprising a structural framework and an array of interfitted skylight modules supported thereby, said structural framework having a plurality of beam members and means for mounting said modules thereon, each of said modules having a quadrangular frame including a pair of lateral frame members and a pair of longitudinal frame members interconnecting said lateral members, means for interfitting each of said lateral frame members side-by-side with a lateral frame member of an adjacent module, means for interfitting each of said longitudinal frame members with a longitudinal frame member of an adjacent module, and preglazed panels held in said frames, said lateral frame members having gutter sections, means to joining said gutter sections of adjacent lateral frame members end-to-end to provide continuous drainage channels, said longitudinal members having gutters sections draining into said gutter sections of said lateral frame members.

5. A skylight system according to claim 4 wherein said modules are supported above said structural framework.

6. A skylight system according to claim 4 wherein said structural framework comprises a plurality of parallel beams disposed along rows of longitudinal members.

7. A skylight system according to claim 4 wherein said lateral frame members carry window washing track segments, end-to-end lateral members providing extended window washing tracks.

8. A skylight system according to claim 4 having sealing means between side-by-side interfitted lateral frame members and between side-by-side interfitted longitudinal frame members.

9. A skylight system according to claim 4 having means connecting lateral members of adjacent frames end-to-end, said joining means providing for relative movement of said end-to-end lateral members to allow for thermal expansion and contraction.

10. A skylight system according to claim 4 wherein said means interfitting said side-by-side longitudinal frame members allow relative movement of said side-by-side longitudinal members to provide for thermal expansion and contraction.

11. A skylight system according to claim 4 wherein said means interfitting said side-by-side lateral frame members allow relative movement of said side-by-side lateral members to provide for thermal expansion and contraction.

12. A skylight system comprising a structural framework and an array of interconnected skylight modules supported thereby, said support lattice having a plurality of beam members and means for mounting said modules thereon, each of said modules having a quadrangular frame including a pair of lateral frame members and a pair of longitudinal frame members interconnecting said lateral members, means for sliding said lateral frame members into lateral frame members of adjacent modules to interfit adjacent lateral frame members and permit relative sliding therebetween to accommodate thermal expansion and contraction, means for sliding said longitudinal frame members into longitudinal frame members of adjacent modules to interfit adjacent longitudinal frame members and permit relative sliding therebetween to accommodate thermal expansion and contraction, and preglazed panels held in said frames, said mounting means having bracket members supporting end-to-end lateral frame members of adjacent modules allowing relative movement of said end-to-end lateral frame members to accommodate thermal expansion and contraction, said lateral frame members having gutter segments which are slid into said bracket means, said bracket members and said gutter segments providing continuous gutter channels, said longitudinal members having gutter segments which drain into said gutter sections of said lateral members.

13. A combination in accordance with claim 12 wherein lateral frame members of adjacent modules are slid into said bracket members.

14. A combination in accordance to claim 12 wherein said means for sliding said lateral frame members into lateral frame members of adjacent modules comprise at least one protrusion of one adjacent lateral frame member and at least one recess of an adjacent lateral frame member which receives said projection.

15. A combination in accordance to claim 12 wherein said means for sliding said longitudinal frame members into longitudinal frame members of adjacent modules comprises at least one protrusion of one adjacent longitudinal frame member and at least one protrusion of another longitudinal frame member.

16. A skylight system for installation on an underlying support framework of beams, said skylight system comprising:

a plurality of preglazed quadrangular modules arranged in a gridwork each having a glazing panel therein, each of said preglazed modules having an edge thereof slideably interconnected with adjacent modules, corner supports at the corners of the preglazed modules extending from the preglazed modules to the underlying support framework beams and attached thereto, said preglazed modules having a pair of parallel purlins and a pair of parallel rafters arranged to form a quadrangular frame for the glazing panel, one of said pair of purlins having a removable glazing retaining member thereon for holding one edge of the glazing panel and the other of said pair of purlins having a non-removable integral glazing retaining member thereon, one of said pairs of rafters having a removable glazing retaining member thereon for holding an edge of the glazing panel and the other of said pair of rafters having a non-removable integral glazing retaining member thereon, said glazing panels being removal from said preglazed modules by removing from said ones of the rafters and purlins the removable glazing members from a module allowing the glazing panel held therebetween to be slid outwardly from under the other integral glazing retaining members of the other purlins and rafters for the module.

* * * * *